US005823161A

United States Patent [19]

Potz et al.

[11] Patent Number: 5,823,161

[45] Date of Patent: Oct. 20, 1998

[54] FUEL INJECTION DEVICE FOR INTERNAL COMBUSTION ENGINES

[75] Inventors: Detlev Potz, Stuttgart; Guenter Lewentz, Hemmingen; Ralf Maier, Schwaebisch Gmuend; Stefan Kampmann, Gerlingen; Uwe Gordon, Markgroeningen; Andreas Kreh; Nestor Rodriguez-Amaya, both of Stuttgart, all of Germany

[73] Assignee: Robert Bosch GmbH, Stuttgart, Germany

[21] Appl. No.: 722,200

[22] PCT Filed: Jan. 19, 1996

[86] PCT No.: PCT/EP96/00230

§ 371 Date: Feb. 25, 1997

§ 102(e) Date: Feb. 25, 1997

[87] PCT Pub. No.: WO96/25596

PCT Pub. Date: Aug. 22, 1996

[30] Foreign Application Priority Data

Feb. 15, 1995 [DE] Germany ..... 195 04 849.0

[51] Int. Cl.[6] ..... F02B 5/00; F02M 61/18

[52] U.S. Cl. ..... 123/305; 239/456

[58] Field of Search ..... 123/446, 467, 123/305, 496; 239/96, 533.3, 533.1, 451, 452, 453, 456, 460

[56] References Cited

U.S. PATENT DOCUMENTS

| | | | |
|---|---|---|---|
| 4,905,908 | 3/1990 | Sczomak | 239/533.12 |
| 5,020,728 | 6/1991 | Linder et al. | 239/533.3 |
| 5,048,489 | 9/1991 | Fischer | 123/467 |
| 5,551,634 | 9/1996 | Raab et al. | 239/533.3 |

*Primary Examiner*—Thomas N. Moulis

*Attorney, Agent, or Firm*—Edwin E. Greigg; Ronald E. Greigg

[57] ABSTRACT

A fuel injection device for internal combustion engines, having a high-pressure fuel pump, which pumps fuel from a low-pressure chamber via a feed line into a high-pressure collection chamber that communicates via high-pressure lines with the individual injection valves that protrude into the combustion chamber of the engine to be supplied. In order for this system to make variable injection cross sections at the injection valves possible, these injection valves are embodied as injection valves with an outward-opening valve member, via whose controllable opening stroke motion in the direction of the combustion chamber, a variable injection cross section can be adjusted at the injection valve.

23 Claims, 5 Drawing Sheets

FUEL INJECTION DEVICE FOR INTERNAL COMBUSTION ENGINES

PRIOR ART

The invention is based on a fuel injection device for internal combustion engines. In one such fuel injection device, known from the professional journal ATZ/MTZ, special issue, *Motor und Umwelt* [Engine and Environment] 1992, pp. 28–30, a high-pressure pump feeds fuel out of a low-pressure chamber into a high-pressure collection chamber (common rail) and there builds up a high-pressure fuel level that is available for the injection, regardless of the engine rpm. From the common rail, high-pressure lines corresponding to the number of injection locations lead away to the individual injection valves that protrude into the combustion chamber of the engine to be supplied; the high-pressure lines discharge there into a pressure chamber that urges the valve member in the opening direction. The control of the opening stroke motion of the valve members of the injection valves, embodied as "inward-opening injection nozzles", is effected by means of a 3/2-way valve, which is inserted into a partial line branching off from the high-pressure line and discharging into a control chamber that urges the valve member in the closing direction. The pressure engagement face, acting in the closing direction, on the valve member of the injection valve is larger than the pressure face acting in the opening direction, so that the valve member, when the control chamber is acted upon by high pressure, is kept pressed against its valve seat. If injection is to occur, the 3/2-way valve connects the control chamber with a fuel tank, so that the pressure in the control chamber is relieved into the tank, and the opening force engaging the valve member is now sufficient to lift the valve member from its seat, so that fuel can be injected via the injection openings. For closing the injection valve, the control chamber is reconnected to the high-pressure line. For shaping the course of injection, a throttle is inserted into the connecting line between the tank and the control chamber, and for rapid closure of the valve member at the end of injection, a check valve that opens in the direction of the control chamber is used.

The known fuel injection device has the disadvantage, however, that with the injection valves used variable injection cross sections are not possible. Especially at low rpm and low load, because of the very high injection pressure in the common rail, this leads to very brief injection durations, which have a disadvantageous effect on fuel preparation in the combustion chamber and consequently on the quality of combustion.

Moreover, the use of a complicated 3/2-way valve to control the injection event is very complicated, making it complicated and expensive to produce the known fuel injection device.

ADVANTAGES OF THE INVENTION

The fuel injection device according to the invention for internal combustion engines, has the advantage over the prior art that the known common rail injection system can be improved such that the advantages of the constantly available high injection pressure can be utilized consistently by means of a variable injection cross section at the injection valve. This is advantageously made possible by the use of an injection valve with an outward-opening valve member, by way of whose adjustable opening stroke a variable injection cross section can be controlled.

The injection valve of the outward-opening type can be controllable in infinitely graduated fashion, to which end an annular gap that can be opened as a function of the valve member stroke and is located between the closing head and the valve seat forms the injection cross section. Advantageously, the injection cross section is meant to be controlled by means of a slide valve preceding the sealing cross section; in its valve member, this slide valve has a plurality, for example, of geometrically accurately determined injection openings, by way of whose arrangement, as a function of the opening stroke, precise injection cross sections can be adjusted when these injection openings emerge from coincidence with the housing. These injection openings are advantageously formed by two rows of injection ports located axially above one another, which are opened in succession during the opening stroke of the valve member. In this way, it is possible in a structurally simple manner, by means of a certain valve member stroke, to open only the lower row of injection ports near the combustion chamber and thus for instance initially to open only half the injection cross section. Control options are provided on the valve member that enable the valve member to persist in this defined intermediate position. Alternatively, however, it is also possible to provide even more rows of injection ports and defined persisting positions of the valve member. The aforementioned injection ports have the advantage over the annular gap that the orientation and course of the stream of fuel to be injected can be better adjusted.

The described opening of only a reduced injection cross section, preferably 50%, has the advantage, especially at low rpm and in the partial-load range of the engine to be supplied, that the duration of injection, despite a high injection pressure, can be adjusted to the optimal amount for favorable fuel preparation.

In this way, in the fuel injection device of the invention, by means of the combination of a variable injection pressure and a variable injection cross section with a freely selectable instant of injection, the fuel injection can be adapted optimally to the various operating points of the engine. Varying the injection pressure is effected in a known manner by regulating the pressure of the common rail.

Another advantage is attained by the use of a simple 2/2-way valve for controlling the injection event at the injection valve, which is advantageously actuated by an electromagnet. As an alternative, however, mechanical, hydraulic or pneumatic actuations are also possible, including the 3/2-way valves known from the prior art.

The closing force exerted on the valve member of the injection valve can be formed by a spring force or by the high pressure in the injection system; to that end, the most various control concepts at the 2/2-way valve are possible; for instance, the magnetic valve can keep the 2/2-way valve open or closed when without current, so that a restoration chamber that receives the combustion chamber-side end of the valve member is pressureless or has pressure imposed on it in the closed state of the injection valve. The intermediate stop that keeps the valve member in a defined position in which it opens only the lower row of injection ports can advantageously be embodied as either a hydraulic stop (a bore is closed) or as a mechanical stop (a second spring comes into action). When the system pressure is used as the closing force, a hydraulically adjustable closing piston at the valve member is especially advantageous; an infinitely graduated stroke path of the valve member is possible by way of the hydraulically adjustable axial length of this closing piston. As a control variable for the opening stroke motion of the valve member, the high fuel pressure in the injection system or the position of the 2/2-way valve can be used.

The various control concepts, depending on the prerequisites of the engine to be supplied, have various advantages, which is why only four possible embodiments will be explained, but whose characteristics can be exchanged with one another and combined. Further advantages and advantageous features of the subject of the invention may be learned from the specification, the drawing and the claims.

BRIEF DESCRIPTION OF THE DRAWINGS

Four exemplary embodiments of the fuel injection device according to the invention for internal combustion engines are shown in the drawings and will be described in further detail below.

DESCRIPTION OF THE EXEMPLARY EMBODIMENTS

Figure 1:
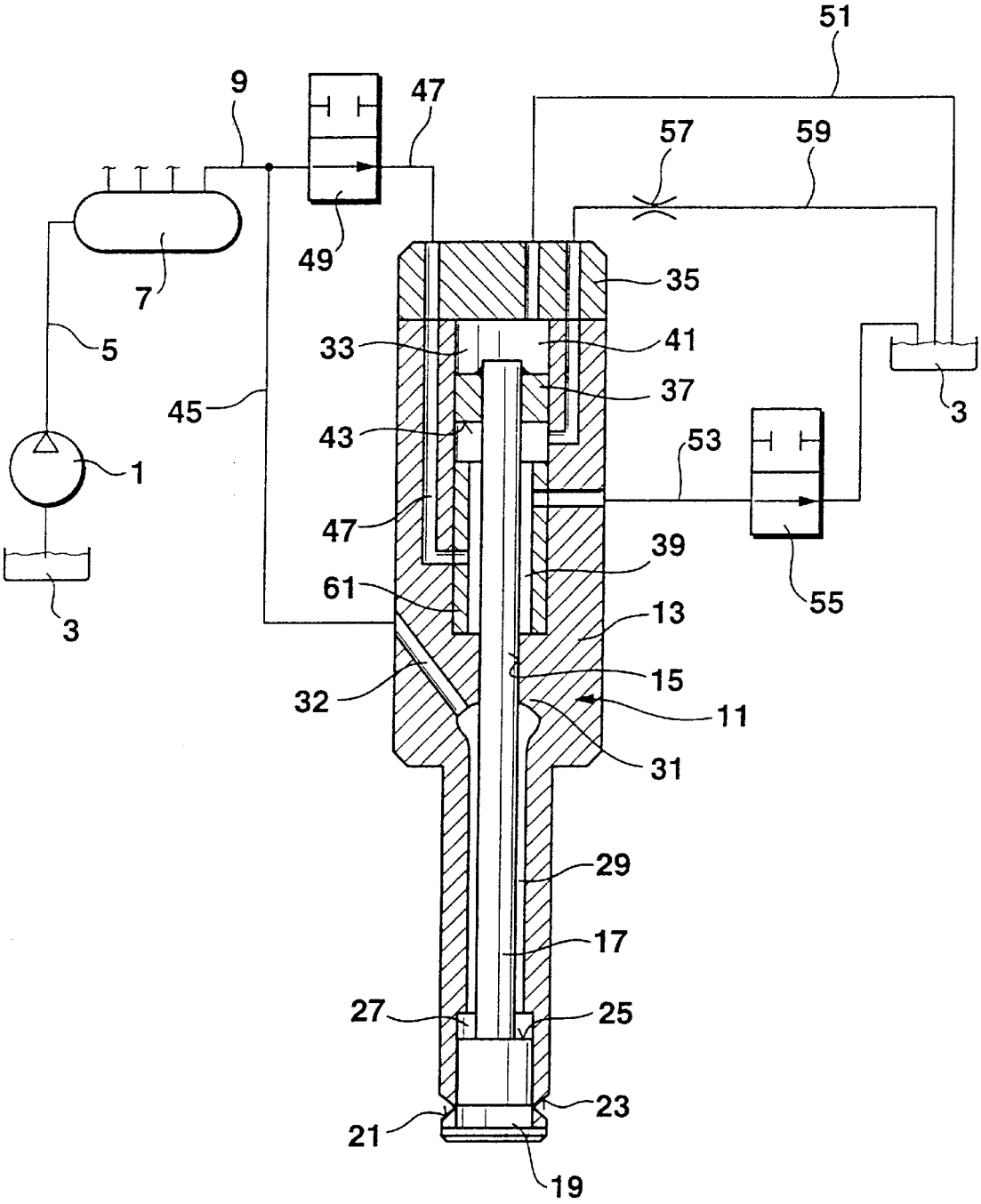
FIG. 1 shows a first exemplary embodiment with a hydraulic closing force at the valve member of the injection valve and with a 2/2-way magnet valve that is open when without current.

The first exemplary embodiment, schematically shown in FIG. 1, of the fuel injection device for internal combustion engines has a high-pressure fuel pump 1, which pumps fuel out of a low-pressure chamber 3, preferably the fuel tank, via a feed line 5 into a high-pressure collection chamber 7. High-pressure lines, corresponding in number to the number of injection locations, lead away from this high-pressure collection chamber 7 to the individual injection valves 11, which protrude into the combustion chamber of the engine to be supplied. The injection valves 11 have a valve body 13 with a central bore 15, in which a pistonlike valve member 17 is axially guided; on its end toward the combustion chamber, this valve member has a closing head 19 protruding from the bore 15 and embodied as a valve closing member. The closing head 19, shown on a larger scale in FIG. 2, has, on its side toward the valve body 13, a sealing face 21, forming a sealing edge, with which it cooperates with a valve seat face 23 disposed on the face end toward the combustion chamber of the valve body 13. With a cross section that is larger than the piston shaft of the valve member 17, the closing head 19 protrudes into a widened-diameter portion of the bore 15, and thus with an end face 25 of the closing head remote from the combustion chamber the closing head defines a pressure chamber 27, which is formed in the bore and extends across an annular gap 29 between the wall of the bore 15 and the valve member shaft as far as a fuel inflow conduit 32 in the valve body 15. The enlarged cross section of the closing head 19 is preferably formed by a sheath 26, which is secured to the closing head 19 and slides axially along the wall of the bore 15 in a sealing manner. In this sheath 26, which forms a movable valve slide, there are preferably two rows of injection openings, axially above one another (injection port rows) 28, which are arranged such that a first lower row, near the combustion chamber, is opened first, after a certain idle stroke, on the emergence of the valve member 17 from the bore 15, while the second, upper row does not leave coincidence with the bore wall of the valve body 13 until after a further valve member stroke. To supply fuel from the annular gap 29 to the injection openings 28, recesses 30 are also provided between the valve member 17 and the sheath 26.

The annular gap 29 is bounded in the direction remote from the closing head 19 by a housing rib 31, in which the diameter of the bore 15 is reduced such that the valve member 17 is guided sealingly and slidably displaceably. This housing land 31 is adjoined in the direction remote from the combustion chamber by a rear chamber 33, formed by another increase in diameter of the bore 15; the end remote from the combustion chamber of the valve member 17 protrudes into this chamber, which is closed with a housing cap 35. On its end remote from the combustion chamber, the valve member has a closing piston 37 forming an actuating part, which slides sealingly along the wall of the rear chamber 33 and thus divides this chamber into a lower partial chamber toward the combustion chamber that forms a restoration chamber 39 and an upper partial chamber remote from the combustion chamber that forms a relief chamber 41; the lower annular end face, toward the combustion chamber, of the closing piston 37 forms a pressure engagement face 43 of the valve member 17 in the closing direction that is larger than the end face 25, acting in the opening direction, of the closing head 19.

For supplying fuel to the injection valve 11 and controlling the opening stroke motion of the outward-opening valve member 17, the high-pressure line 9 branches, near the injection valve 11, into two partial lines, of which a first partial line 45 discharges unthrottled into the fuel inflow conduit 32 and on into the pressure chamber 27, and a second partial line 47 discharges into the restoration chamber 39 of the rear chamber 33; the partial line 47 is closable by means of a 2/2-way valve 49 that is inserted into it and is controllable by means of an electromagnet.

For pressure relief of the upper relief chamber 41 of the rear chamber 33, a relief line 51 leads from the rear chamber into the low-pressure chamber 3.

For controlling the opening stroke motion, a diversion line 53 leads out of the restoration chamber 39, located toward the bottom, and discharges into the rear chamber 33 in such a way that during the reciprocating motion of the closing piston 37 it cannot be closed by that piston; a control magnet valve 55, embodied as a 2/2-way valve, inserted into this diversion line opens the diversion line 53 into the low-pressure chamber 3 or closes it and can be used from a plurality of injection valves.

A throttle line 59 containing a throttle restriction 57 also leads from the restoration chamber 39 into the low-pressure chamber 3; its orifice is arranged in the restoration chamber 39 in such a way that after it has executed a certain opening stroke distance it can be closed by the closing piston 37; this opening stroke position of the valve member 17 then corresponds to the opening of the lower row of injection ports.

To limit the maximum opening stroke length of the valve member 17, a stop sheath 61 is inserted into the restoration chamber 39; its upper annular face forms a stop that cooperates with the pressure face 43 of the closing piston 37, and it has passageway openings for the second partial line 47 and the diversion line 53.

Figure 2:
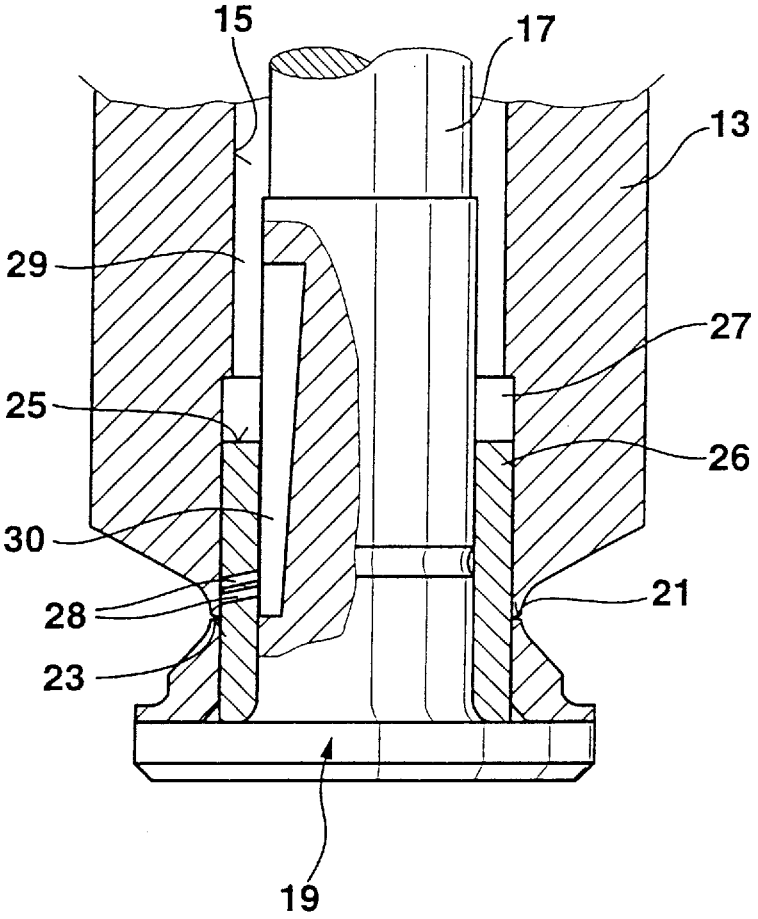
FIG. 2 is an enlarged sectional view of the injection valve of FIG. 1 in the region of the injection openings.

The first exemplary embodiment shown in FIGS. 1 and 2 functions as follows.

In the closed state of the injection valve 11, the 2/2-way valve 49 is open (the electromagnet is without current), so that the high fuel pressure built up by the high-pressure pump 1 in the high-pressure collection chamber 7 is propagated into the restoration chamber 39 of the rear chamber 33. The high pressure engaging the pressure face 43 of the closing piston 37 keeps the valve member 17 pressed by its sealing face 21 against the valve seat face 23.

For opening the injection valve 11, the 2/2-way valve 49 (with current) disconnects the connection of the rear chamber 33 and the high-pressure collection chamber 7. The high pressure in the lower restoration chamber 39 drops via the throttle line 59, and this event and thus the course of the opening stroke of the valve member 17 can be adjusted via the throttle 57. With the drop in closing force acting upon the valve member 17, the opening pressure now prevailing in the pressure chamber 27 and acting on the valve member 17 via the face 25 suffices to lift the valve member 17 from the valve seat 23 and to uncover the injection openings 28.

In this process, the valve member 17 is initially displaced only far enough that the closing piston 37 closes the throttle line 59, and the now-closed lower restoration chamber 39 forms a hydraulic stop; in this position, the lower row of injection ports is opened. If the opening stroke of the valve member 17 is to be continued, then the control valve 55 opens the diversion line 53, and the pressure in the lower restoration chamber 39 is relieved into the low-pressure chamber 3, so that the valve member 17 can execute its maximum opening travel as far as the contact of the closing piston 37 with the stop sheath 61, and thus it opens the second, upper row of injection ports of the injection openings 28 as well. If persistence of the valve member 17 in the intermediate position is to be prevented, then it is possible, by immediately opening the diversion line 53, for a rapid maximum opening stroke to be executed.

For re-closing the injection valve 11, the 2/2-way valve is re-opened, so that in the lower restoration chamber 39, with the diversion line 53 now closed, the high fuel pressure now builds up again and pushes the valve member 17 back onto its valve seat 23.

The second exemplary embodiment shown in FIG. 3 differs from the first only in the type of control of the opening stroke motion of the valve member, and so in its description reference will be made only to these components; identical components are identified by the same reference numerals as in the first exemplary embodiment.

A throttle restriction 63 is now inserted into the second partial line 47 branching off from the high-pressure line 9 and discharging into the lower restoration chamber 39. A control line 65 also leads away from the restoration chamber 39, discharging into the low-pressure chamber 3, and is closable by the electromagnetically controlled 2/2-way valve 49 now inserted into it.

Figure 3:
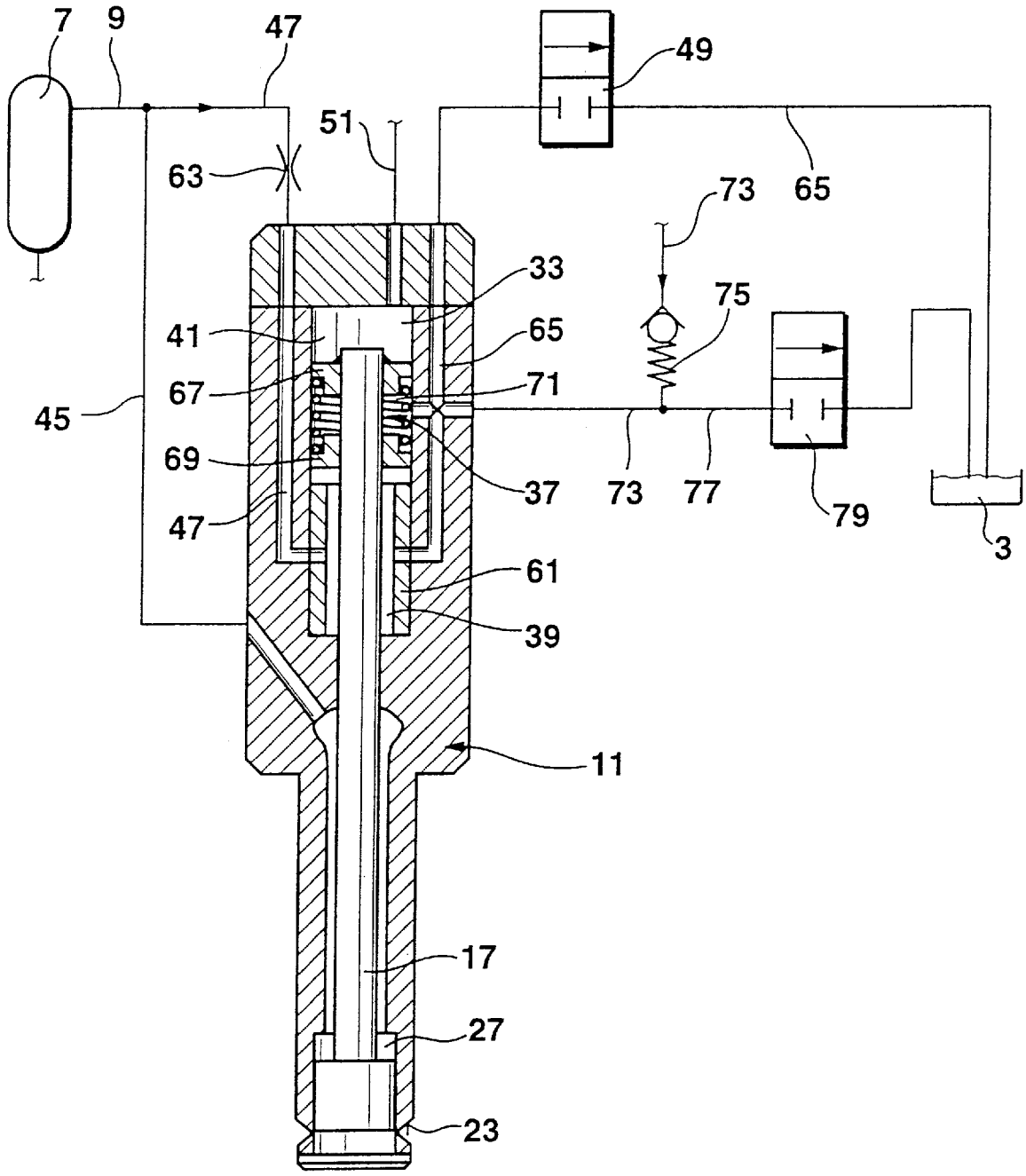
FIG. 3 shows a second exemplary embodiment with a hydraulic closing force at the valve member, a 2/2-way valve that is closed when without current, and a hydraulically adjustable closing piston.

The closing piston 37 is embodied in two parts in FIG. 3; an upper piston part 67, remote from the combustion chamber, is firmly joined to the end of the valve member 17 protruding into the rear chamber 33, and a lower piston part 69, remote from the combustion chamber, is guided axially displaceably on the valve member shaft. The space enclosed between the piston parts 67, 69 forms an adjusting chamber 71, which can be filled with fuel via a fuel line 73 that is fed from the low-pressure chamber 3 and has a check valve 75 opening in the direction of the adjusting chamber 71, and which can be relieved into the low-pressure chamber via a partial line 77, which branches off from the fuel line 73 and is openable by means of a control valve 79.

A compression spring 81 fastened between the piston parts 67, 69 displaces the piston parts 67, 69 into their outset position when the rear chamber 33 is relieved.

The second exemplary embodiment shown in FIG. 3 functions as follows.

With the injection valve 11 closed, the 2/2-way valve 49 inserted into the control line 65 is closed (currentless), so that via the second partial line 47, the high fuel pressure builds up in the restoration chamber 39 and acts upon the lower piston part 69 in the closing direction of the valve member 17. This closing force is transmitted, depending on the filling of the adjusting chamber 71 either directly or via a hydraulic cushion to the upper piston part 67 firmly joined to the valve member, so that the valve member 17 is held on the valve seat 23.

For opening the injection valve 11, the 2/2-way valve 49 opens (current is supplied to it), so that the pressure in the restoration chamber 39 is relieved into the low-pressure chamber 3. As a consequence, the pressure in the pressure chamber 27, acting in the opening direction on the valve member 17, suffices to lift the valve member 17 from its seat 23, and this opening stroke motion continues until the lower piston part 69 is in contact with the stop sheath 61. A variable control of the stroke of the valve member, and in particular causing the valve member 17 to persist in the position that opens only the lower row of injection ports is attained by means of a defined filling of the adjusting chamber 71, to which end for a minimum stroke, this hydraulic volume is filled completely via the fuel line 73, and for a maximum stroke, it is correspondingly emptied via the control valve 79; intermediate positions are also possible by suitable filling of the adjusting chamber 71.

The closure of the injection valve 11 is effected by re-closing the 2/2-way valve 49; as a result, the closing pressure in the restoration chamber 39 of the restoration chamber 33 builds up again, and the valve member 17 is moved back onto its valve seat 23.

Figure 4:
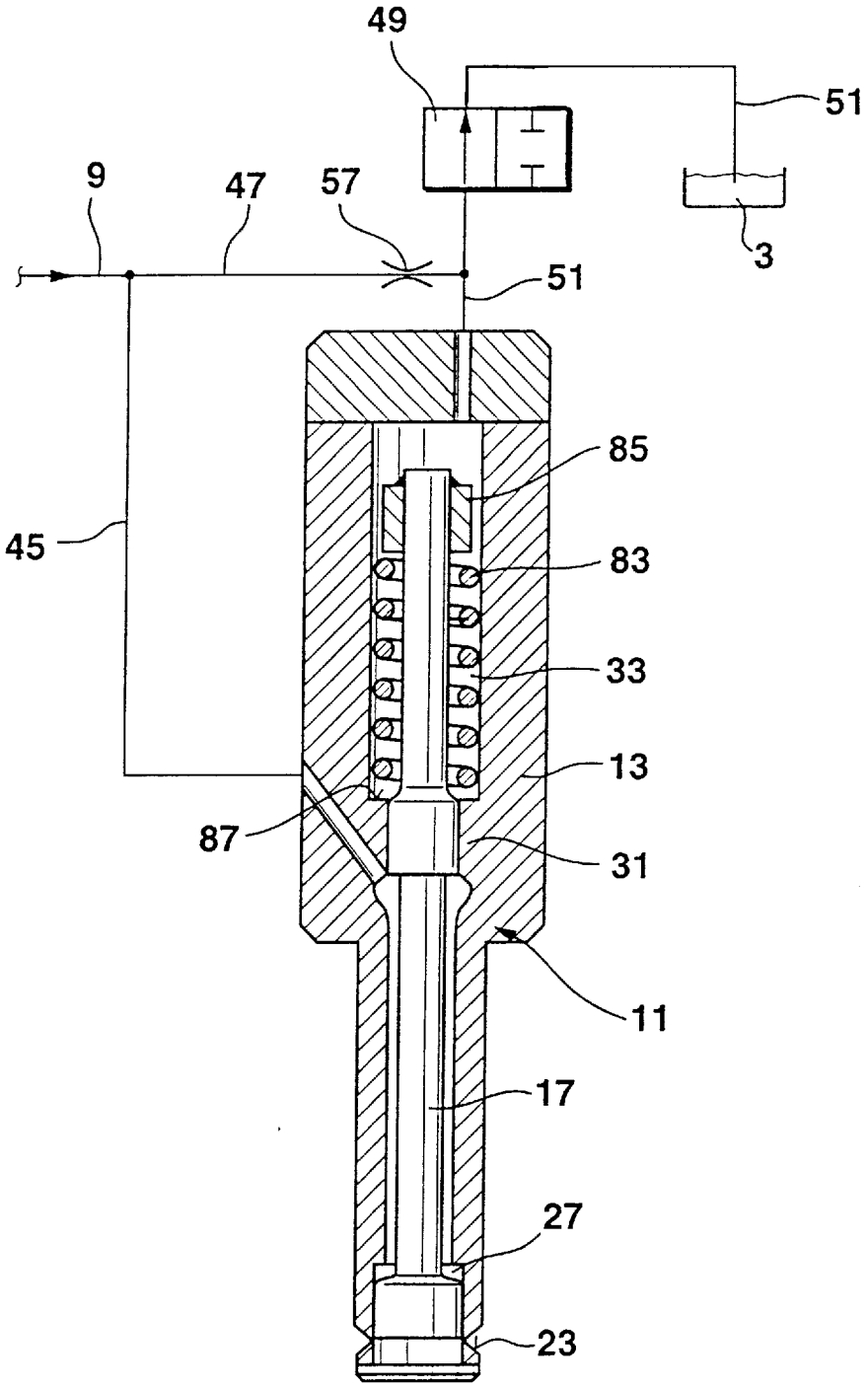
FIG. 4 shows a third exemplary embodiment, in which the closing force, for a 2/2-way magnet valve that is open when without current, is brought to bear by a closing spring.

The third exemplary embodiment shown in FIG. 4 differs from the above exemplary embodiments and the type of closing force exerted on the valve member 17, which here is generated by a spring force.

To that end, a valve spring 83 is disposed in the rear chamber 33; it is fastened between a spring plate 85, disposed on the end of the valve member 17 remote from the combustion chamber, and an annular shoulder 87 that defines the rear chamber 33 toward the combustion chamber, and it keeps the valve member 17 in contact with the valve seat 23 counter to the high fuel pressure prevailing in the pressure chamber 27 and urging the valve member 17 in the opening direction. Leading away from the rear chamber 33 is a relief line 51, which discharges into the low-pressure chamber 3 and can be closed via the 2/2-way valve 49 inserted therein. In addition, the second partial line 47, forming a connecting line between the high-pressure line 9 and the rear chamber 33, discharges into the relief line 51 between the rear chamber 33 and the 2/2-way valve 49; in the third exemplary embodiment of the fuel injection device of the invention, a throttle restriction 57 is provided in the second partial line 47.

The third exemplary embodiment shown in FIG. 4 functions as follows.

In the closed state of the injection valve 11, the 2/2-way valve 49 disposed in the relief line 51 or second partial line 47 is open (currentless), so that no high fuel pressure can build up in the rear chamber 33, and the valve spring 83 keeps the valve member 17 on the valve seat 23, counter to the high fuel pressure prevailing in the pressure chamber 27 and urging the valve member 17 in the opening direction. To open the injection valve 11, the 2/2-way valve 49 closes the pressure-relieving communication between the rear chamber 33 and the low-pressure chamber 3, so that the high fuel pressure of the injection system builds up in the rear chamber 33 via the second partial line 47. The resultant pressure force now engaging the valve member part protruding into the rear chamber 33, which is in the opening direction of the valve member 17, combined with the pressure force present in the pressure chamber 27 is greater than the restoring force of the valve spring 83, so that the valve member 17 is lifted from the valve seat 23 and uncovers the injection openings. Via a progressive characteristics curve of the valve spring 83 or a defined idle stroke, the valve member 17 can be made to persist in its position in which initially only the lower row of injection ports is opened; the high fuel pressure of the high-pressure collection chamber is used then as the control pressure.

For closing the injection valve at the end of the injection event, the 2/2-way valve 49 again opens the relief line 51 into the low-pressure chamber 3, so that the high fuel pressure in the rear chamber 33 rapidly drops, and the valve spring 83 moves the valve member 17 back onto the valve seat 23.

Figure 5:
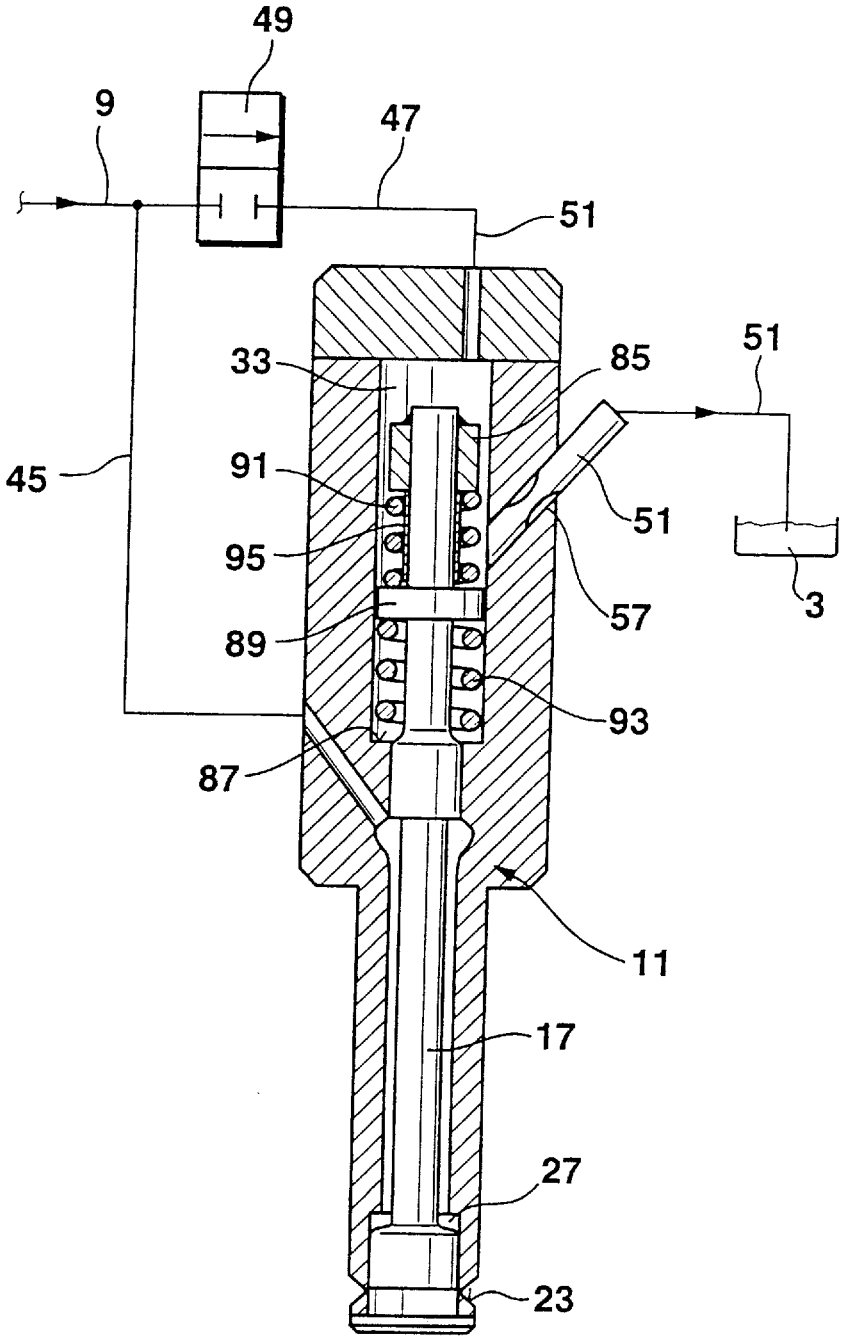
FIG. 5 shows a fourth exemplary embodiment, in which the closing force, for a 2/2-way magnet valve that is closed when without current, is brought to bear by a two-spring assembly.

In the fourth exemplary embodiment shown in FIG. 5, the second partial line 47, originating at the high-pressure line 9, discharges directly into the rear chamber 33; the second partial line 47 is closable by means of the 2/2-way valve inserted into it. The pressure relief of the rear chamber 33 is effected by means of the relief line 51, which extends away from it into the low-pressure chamber 3 and which in the fourth exemplary embodiment has a throttle restriction 57.

The closing or restoring force on the valve member 17 is generated by a two-spring assembly; to that end an annular step 89 is provided on the portion of the shaft of the valve member protruding into the rear chamber 33, between the spring plate 85 disposed on the end toward the combustion chamber and the annular shoulder 87 that defines the rear chamber 33. A first valve spring 91 is fastened between the spring plate 85 and the annular step 89, and a second valve spring 93 is fastened between the annular step 89 and the annular shoulder 87 that is firmly connected to the housing; the spring stiffness of the first valve spring 91 is less than that of the second valve spring 93. To adjust the pilot stroke motion of the valve member 17 that is executed counter to the force of the first valve spring 91, in the exemplary embodiment described a sheath 95 is secured to the annular end face, toward the spring, of the spring plate 85; the end face remote from the spring plate 85 rests on the annular step 89 after a pilot stroke motion has been executed, and then, taking the first valve spring 91 out of action, establishes a rigid connection between the spring plate 85 and the spring step 89, so that only the second valve spring 93 is operative as the opening stroke continues. Alternatively, this persistence in an intermediate position can alternatively be attained without a sheath 95, in which case both valve springs are operative in the remaining stroke.

The fourth exemplary embodiment shown in FIG. 5 functions as follows.

With the injection valve 11 closed, the 2/2-way valve 49 inserted into the line 47 is closed (currentless), so that via the relief line 51 containing a defined throttle 57, the rear chamber 33 is relieved to a certain pressure. The valve member 17 is held in contact with the valve seat 23 by the force of the valve springs 91, 93, counter to the pressure in the pressure chamber 27. If injection is to take place, then the 2/2-way valve opens, and so the high fuel pressure of the injection system builds up in the rear chamber 33 and as described in conjunction with FIG. 4 urges the valve member 17 in the opening direction. Initially, counter to the lesser spring force of the first valve spring 91, a pilot stroke is executed until the contact of the sleeve 95 with the annular step 89; this pilot stroke is sufficient at the valve member 17 to open the lower row of injection ports. The valve member 17 can be held in this position by clocked triggering of the 2/2-way valve 29 in order to maintain a constant pressure in the rear chamber 33. If the entire injection cross section is to be opened at the valve member 17, then the supply of pressure to the rear chamber 33 is not interrupted, and thus the fuel pressure in the rear chamber 33 rises in such a manner that the valve member 17, counter to the force of the second valve spring 17, is moved farther into a position in which the second, upper row of injection ports is opened as well.

For subsequent closure of the injection valve 11, the 2/2-way valve 49 is closed again, so that the high pressure in the rear chamber 33 is relieved via the relief line 51 into the low-pressure chamber 3, and the valve springs 91, 93 move the valve member 17 back onto its seat 23.

The actuation of the 2/2-way control valves 49 is effected, in all the variant embodiments, by means of an electromagnet, which is triggered by an electronic control unit not shown; in a known manner, the control unit processes many operating parameters of the engine to be supplied.

It is thus possible in a structurally simple way to combine the advantages of a "common rail" injection system with the advantages of an injection valve of the outward-opening type, so that now in addition to a freely selectable, variable onset and end of injection and a variable injection pressure, a variable injection cross section is also freely adjustable over the entire performance graph of the engine to be supplied, and this fuel injection device is controllable in a simple way with a 2/2-way valve.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection device for internal combustion engines, having a high-pressure fuel pump (1), which pumps fuel from a low-pressure chamber (3) via a feed line (5) into a high-pressure collection chamber (7), said high-pressure collection chamber communicates via high-pressure lines (9) with individual injection valves (11), each of said individual injection valves protrude into a combustion chamber of the engine to be supplied, the opening and closing motions of said valves are each controlled by one control valve inserted into the high-pressure line (9) at the injection valve (11), the injection valve (11) has an outward-opening valve member (17), and a variable fuel injection cross section at the injection valve (11) can be adjusted via a controllable opening stroke motion in a direction of the combustion chamber.

2. The fuel injection device in accordance with claim 1, in which the valve member (17) has a valve shaft, which is guided through a bore (15) of a valve body (13) of the injection valve (11) and which on a valve end toward the combustion chamber has a closing head (19) that protrudes out of the bore (15) and forms a valve closing member and which on an end toward the valve body (13) has a sealing face (21) that forms a sealing edge, with which the sealing edge cooperates with a valve seat face (23) disposed on a face end toward the combustion chamber of the valve body (13), and having a pressure chamber (27) that communicates with the high-pressure line (9) and disposed between a shaft of the valve member (17) and a wall of the bore (15), that is defined toward the combustion chamber by the closing head (19), and an axially pointing pressure face (25) defined between the valve seat (23) and the valve shaft is disposed on the valve member (17).

3. The fuel injection device in accordance with claim 2, in which the injection cross section at the injection valve (11) is controlled by a slide valve assembly, said slide valve assembly includes a movable slide part that is adjusted together with the valve member (17), and whose opening cross-section that forms the injection cross section is located upstream of the valve seat (23).

4. The fuel injection device in accordance with claim 3, in which the injection cross section is not opened until after a certain stroke of the valve member (17) in an opening direction has been executed.

5. The fuel injection device in accordance with claim 3, in which a portion of the valve member (17) is embodied as a movable slide part, which is guided in the bore (15) in a region of the closing head (19) and has two rows of injection openings (28) distributed over its circumference, located axially one above the other, which are arranged, beginning at the pressure chamber (27), in such a way that the outlet openings of the axially staggered injection openings (28) can be opened toward the combustion chamber in succession during the opening stroke motion of the valve member (17) by emerging from a coincidence with the bore (15) at the control edge formed by the valve seat face (23).

6. The fuel injection device in accordance with claim 2, in which the valve member (17) is connected on its end remote from the combustion chamber to an actuating part that defines a rear chamber (33) in the valve body (13) that can be made to communicate with the high-pressure line (9), and at least in operative connection via a high-pressure filling or high-pressure relief, the opening motion and/or closing motion of the valve member (17) can be controlled by the control valve.

7. The fuel injection device in accordance with claim 1, in which the control valve that controls the opening and closing motions of the injection valve (11) is embodied in the high-pressure line as an electrically controlled multiposition valve (49).

8. The fuel injection device in accordance with claim 7, in which the electrically controlled multiposition valve (49) is an electro magnet valve.

9. The fuel injection device in accordance with claim 6, in which the injection valve (11) communicates via two partial lines with the high-pressure collection chamber (7), of which a first partial line (45) connects the pressure chamber (27), formed between the valve member (17) and the bore (15) and acting in the opening direction upon the valve member (17), continuously with the high-pressure collection chamber (7), and a second partial line (47) discharges into a restoration chamber (39), separate from the pressure chamber (27), and the filling of this restoration chamber (39) with fuel at high pressure is controllable by means of the control valve embodied as an electrically controlled multiposition valve (49).

10. The fuel injection device in accordance with claim 9, in which the actuating part of the valve member (17) has a closing piston (37), whose end face toward the combustion chamber has a pressure engagement face (43), by way of which the valve member (17) can be urged in the closing direction and which is larger than the pressure face (25) on the valve member (17) acting in the open direction, and the closing piston (37) slides sealingly along the wall of the rear chamber (33) and thus divides said rear chamber into a relieved upper relief chamber (39, 41), remote from the combustion chamber, and the lower restoration chamber (39), toward the combustion chamber, in the valve body (13).

11. The fuel injection device in accordance with claim 10, in which the electrically controlled multiposition valve (49) is inserted into the second partial line (47) of the high-pressure line (9).

12. The fuel injection device in accordance with claim 11, in which the multiposition valve (49) is embodied as a 2/2-way valve, and the restoration chamber (39) communicates constantly with the low-pressure chamber (3) via a throttle line (59) containing a throttle (57).

13. The fuel injection device in accordance with claim 10, in which a diversion line (53) that is not closable by the closing piston (37) during its reciprocating motion leads from the restoration chamber (39) into the low-pressure chamber (3), which can be opened and closed by an electrically controlled valve (55).

14. The fuel injection device in accordance with claim 12, in which the throttle line (59) from the restoration chamber (39) into the low-pressure chamber (3) is closed by the closing piston (37) after an opening stroke travel of the valve member (17) has been executed that opens the lower row, toward the combustion chamber, of injection openings (28).

15. The fuel injection device in accordance with claim 10, in which a stroke stop (61) is provided in the restoration chamber (39), against which stop, the closing piston (37) comes to rest with its pressure engagement face (43) after executing a maximum opening stroke motion.

16. The fuel injection device in accordance with claim 10, in which a throttle restriction (63) is disposed in the second partial line (47) of the high-pressure line (9), and that a diversion line (65) leads from the restoration chamber (39) into the low-pressure chamber (3) and is closable by the multiposition valve (49) that controls the opening and closing motions of the valve member (17).

17. The fuel injection device in accordance with claim 15, in which the axial length of the closing piston (37) in the direction of the lower restoration chamber (39) is variable.

18. The fuel injection device in accordance with claim 17, in which the closing piston (37) is formed of two piston parts, of which an upper piston part (67), remote from the combustion chamber, is firmly connected to the valve member (17) and a lower piston part (69), remote from the combustion chamber, is guided axially displaceably on the shaft of the valve member (17), and enclosed between the piston parts (67, 69) is an adjusting chamber (71), from which a fuel line (73) that can be opened by an electrically controlled valve (79) leads away into the low-pressure chamber (3), and a compression spring (81) is fastened between the piston parts (67, 69) in the adjusting chamber (71).

19. The fuel injection device in accordance with claim 9, in which the shaft of the valve member (17) is guided tightly in a portion of the bore (15) that defines the rear chamber (33), and that the valve member (17), on its end remote from the combustion chamber that plunges into the rear chamber (33), has a spring plate (85), between said spring plate and an annular shoulder (87), formed at the transition of the bore (15) to the rear chamber (33), a valve spring (83) that urges the valve member (17) in the closing direction is fastened.

20. The fuel injection device in accordance with claim 19, in which a throttle restriction (57) is provided in the second partial line (47), and that from the rear chamber (33), a relief line (51) into the low-pressure chamber (3) branches off from the second partial line (47), and an electrically controlled multiposition valve (49) that controls the opening motion of the valve member (17) is inserted into this relief line.

21. The fuel injection device in accordance with claim 9, in which an on end remote from the combustion chamber, the valve member (17) has a spring plate (85), between which plate and the wall of the rear chamber (33), formed by an annular shoulder (87) of the bore (15) in the valve body (13), a valve spring assembly is fastened that is formed of two springs (91, 93), which urge the valve member (17) in the closing direction and which become operative in succession during the opening stroke motion of the valve member (17).

22. The fuel injection device in accordance with claim 19, in which the multiposition valve (49) that controls the opening motion of the injection valve (11) is inserted into the second partial line (47) that discharges into the rear chamber (33), and that a relief line (51) containing a throttle restriction (57) leads away from the rear chamber (33) into the low-pressure chamber (3).

23. The fuel injection device in accordance with claim 21, in which the multiposition valve (49) that controls the opening motion of the injection valve (11) is inserted into the second partial line (47) that discharges into the rear chamber (33), and that a relief line (51) containing a throttle restriction (57) leads away from the rear chamber (33) into the low-pressure chamber (3).

* * * * *